US007367616B2

(12) United States Patent
Summerford

(10) Patent No.: US 7,367,616 B2
(45) Date of Patent: May 6, 2008

(54) FOLDING BOAT SEAT

(75) Inventor: Roark H. Summerford, Hendersonville, TN (US)

(73) Assignee: Triton Boat Company, L.P., Ashland City, TN (US)

( * ) Notice: Subject to any disclaimer, the term of this patent is extended or adjusted under 35 U.S.C. 154(b) by 249 days.

(21) Appl. No.: 11/202,457

(22) Filed: Aug. 12, 2005

(65) Prior Publication Data

US 2007/0035166 A1 Feb. 15, 2007

(51) Int. Cl.
*A47C 1/126* (2006.01)
*A47C 9/06* (2006.01)

(52) U.S. Cl. ..... 297/14; 297/334

(58) Field of Classification Search ..... 297/14, 297/331, 334, 344.16, 344.19
See application file for complete search history.

(56) References Cited

U.S. PATENT DOCUMENTS 1,002,863 A * 9/1911 Packard ..... 105/327
1,231,129 A 6/1917 Cluff, Jr.
1,355,005 A * 10/1920 Schechter ..... 297/16.1
1,428,018 A 9/1922 Erickson
1,685,137 A 9/1928 Nichols
1,698,036 A * 1/1929 Trammell ..... 297/14
1,761,673 A * 6/1930 Laursen ..... 297/14
3,594,037 A 7/1971 Sherman
3,873,151 A 3/1975 Morris et al.
4,030,436 A 6/1977 Stöberl
4,460,215 A 7/1984 Chamberlain et al.
4,527,828 A 7/1985 Groce et al.
4,639,037 A 1/1987 Maruyama et al.
4,771,507 A 9/1988 Draplin et al.
4,787,675 A 11/1988 Mcleod
4,955,973 A 9/1990 Provencher
4,995,681 A 2/1991 Parnell
5,046,722 A 9/1991 Antoon
5,048,132 A 9/1991 Rizzo
5,185,892 A 2/1993 Mitchell
5,328,239 A 7/1994 Yamazaki
5,655,459 A 8/1997 O'Connor et al.
5,791,729 A 8/1998 McCormick et al.
5,819,670 A 10/1998 O'Connor et al.
6,283,059 B1 9/2001 Scully, Jr.
6,343,834 B1 2/2002 Wurmlinger
6,487,979 B2 12/2002 Ash et al.
6,527,341 B1 3/2003 Martin
6,606,806 B2 8/2003 Butters et al.
6,647,916 B2 11/2003 Neese et al.
6,684,540 B1 2/2004 Tufts
6,692,076 B1 2/2004 Burer
6,789,494 B2 9/2004 Smith et al.
6,807,690 B1 10/2004 Satterfield

* cited by examiner

*Primary Examiner*—Joe Edell
(74) *Attorney, Agent, or Firm*—Luedeka, Neely & Graham, PC

(57) ABSTRACT

A folding boat seat system mountable to a vertical mounting surface such as a bulkhead of the boat. The system includes a seat; a pair of guide followers extending from opposite sides of the seat; a pair of guides mountable to the mounting surface and configured for receiving the guide followers; a substantially U-shaped frame member having opposite ends pivotally mounted adjacent the guide followers; and a pair of bias struts, each having a first end pivotally mounted adjacent one of the guides and a second end pivotally mounted to support the seat.

2 Claims, 5 Drawing Sheets

FOLDING BOAT SEAT

FIELD

This invention relates generally to folding seats. More particularly, this invention relates to a folding bench seat that is particularly suitable for installation on a boat.

BACKGROUND AND SUMMARY

Folding seats are often utilized for space efficiency. For example, in boats, space is limited and folding seats are utilized to enable more efficient use of deck space. While various folding seats exist, improvement is desired.

In this regard, the invention relates to a folding support that is particularly useful to provide a folding seat. In a preferred embodiment, the folding support includes a seat; a pair of guide followers extending from opposite sides of the seat; a pair of guides mountable to the mounting surface and configured for receiving the guide followers; a substantially U-shaped frame member having opposite ends pivotally mounted adjacent the guide plates; and a pair of bias struts, each having a first end pivotally mounted adjacent one of the guide plates and a second end pivotally mounted to the seat. In a stowed position, the seat, the frame and the bias struts are all folded together and oriented substantially vertically adjacent to a vertical mounting surface. In a use position, the support (seat) is substantially horizontal and the frame is disposed in an inclined position below and supporting the seat, while the strut is in an inclined position urging the seat up and away from the vertical mounting surface.

As used herein, the term "adjacent" is used in its broad sense to include touching and non-touching relationships. In other words "adjacent" objects could be touching or spaced apart, but near. In addition, terms like "pivotally mounted to" are used broadly to include both touching and non-touching relationships. Objects that are "pivotally mounted to" each other could be touching, or they could be non-touching, separated by a pivotal mounting system and/or other structure.

BRIEF DESCRIPTION OF THE DRAWINGS

Further features of preferred embodiments of the invention will become apparent by reference to the detailed description of preferred embodiments when considered in conjunction with the figures, which are not to scale, wherein like reference numbers, indicate like elements through the several views, and wherein.

DETAILED DESCRIPTION

Figure 1:
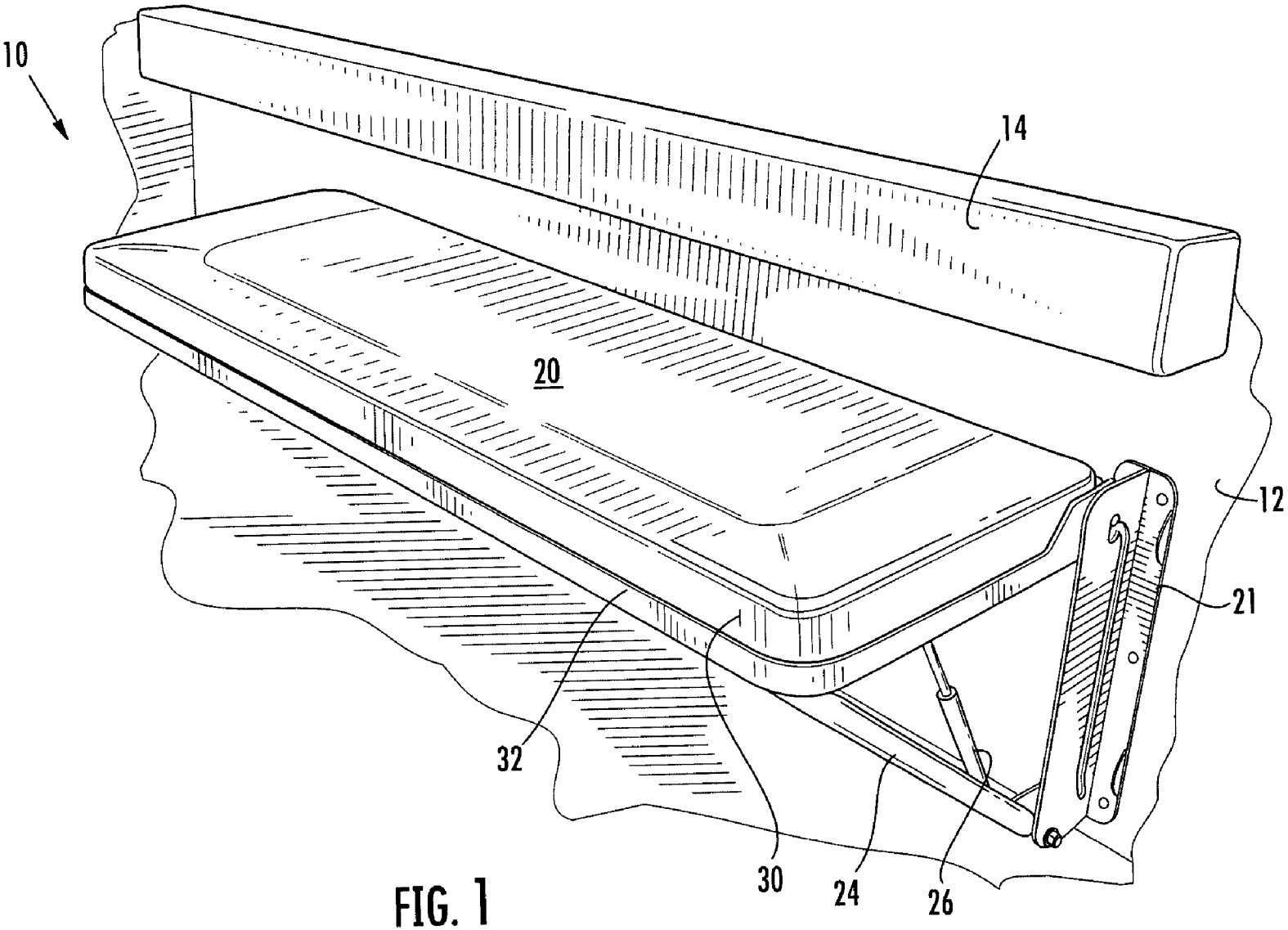
FIG. 1 is a front perspective view of a folding seat according to the invention installed on a bulkhead of a boat and oriented for being sat upon.
Figure 2:
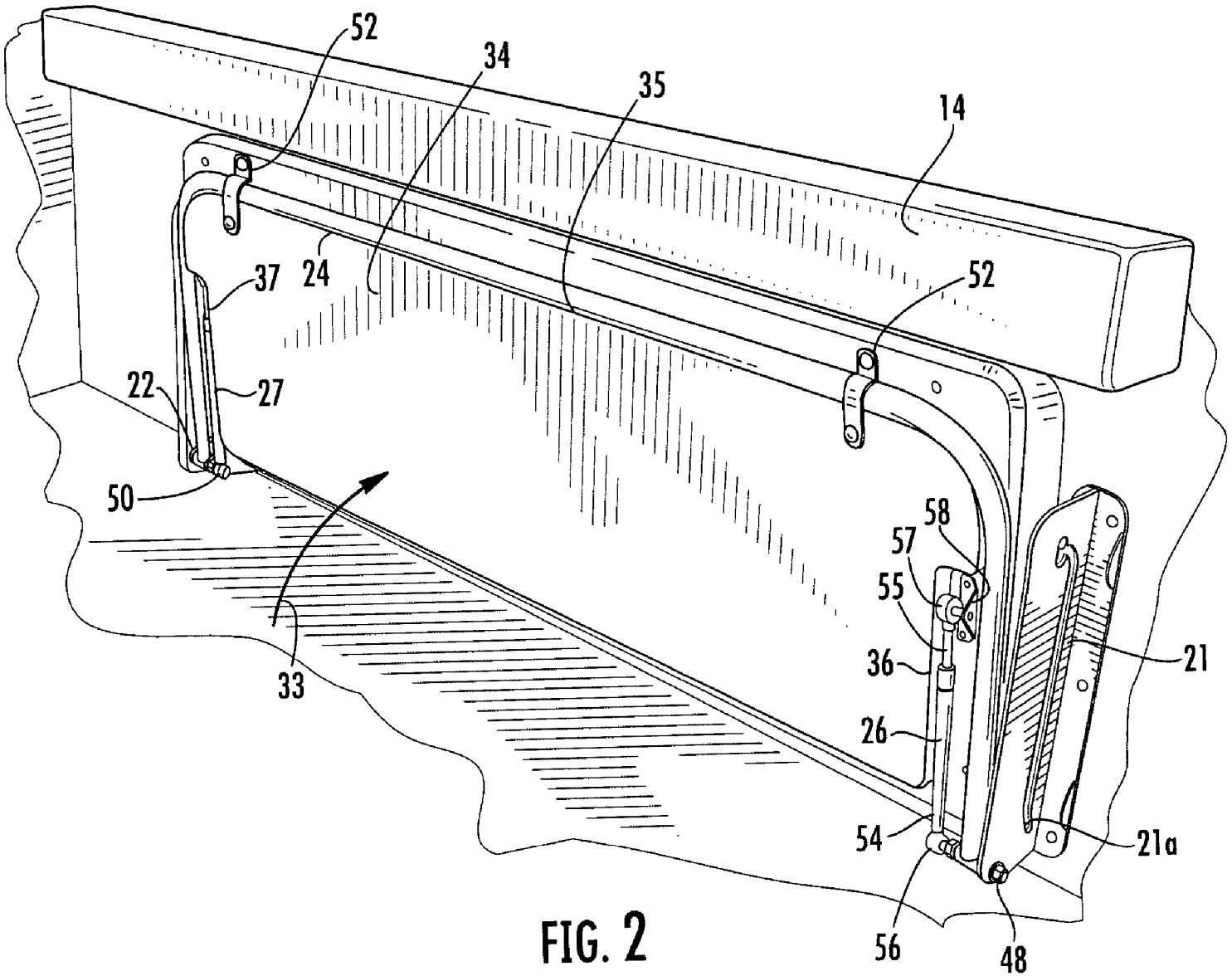
FIG. 2 shows the seat of FIG. 1 in a stowed or folded orientation.
Figure 3:
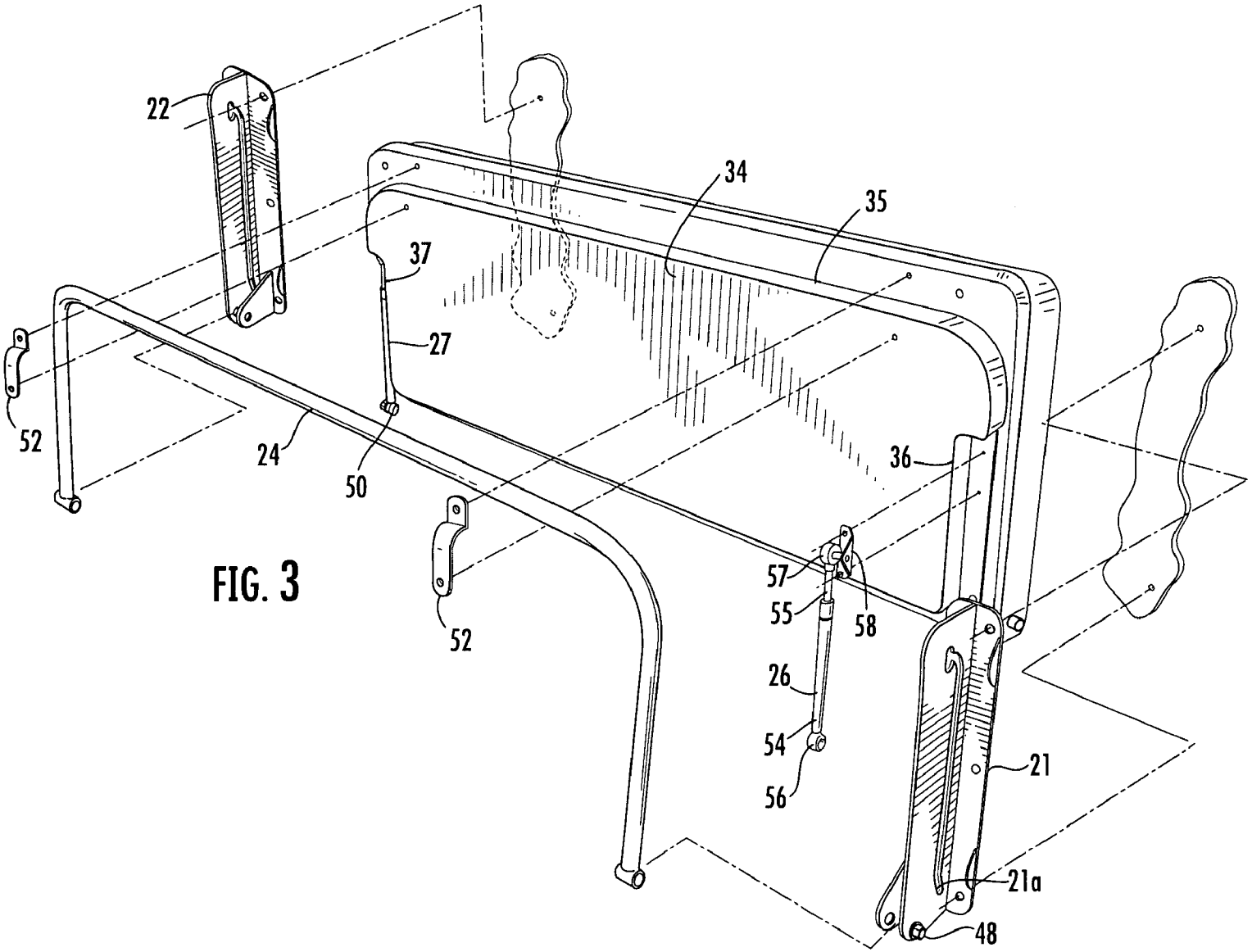
FIG. 3 is an exploded view of the seat of FIG. 1.

With reference to FIGS. 1-3, the invention relates to a folding system 10 that is particularly useful for providing a folding bench seat on a boat. However, it will be understood that the system may also be configured for use in other vehicles and structures and may also be configured to provide a support other than a seat, such as a table or a bed.

The system 10 is preferably mounted onto a surface of the boat such as a transom or a bulkhead 12 or other upright surface of a boat, with a cushion or back support 14 also preferably mounted to the bulkhead 12. The system 10 preferably includes, as major components, a support 20, a pair of guide plates 21 and 22, a pair of guide followers 21*a* and 22*a*, a leg frame 24, and a pair of bias struts 26 and 27.

The support 20 is substantially planar and preferably configured as a bench seat and includes a cushioned seat surface 30 overlying and fixedly mounted to a rigid planar substrate 32, preferably of substantially rectangular shape with rounded corners and of molded plastic or fiberglass construction. The planar substrate 32 preferably includes a lower surface 33 configured to define a handle recess 34, a shoulder 35 for abutting the leg frame 24, and strut recesses 36 and 37 for mounting of the struts 26 and 27.

Figure 4:
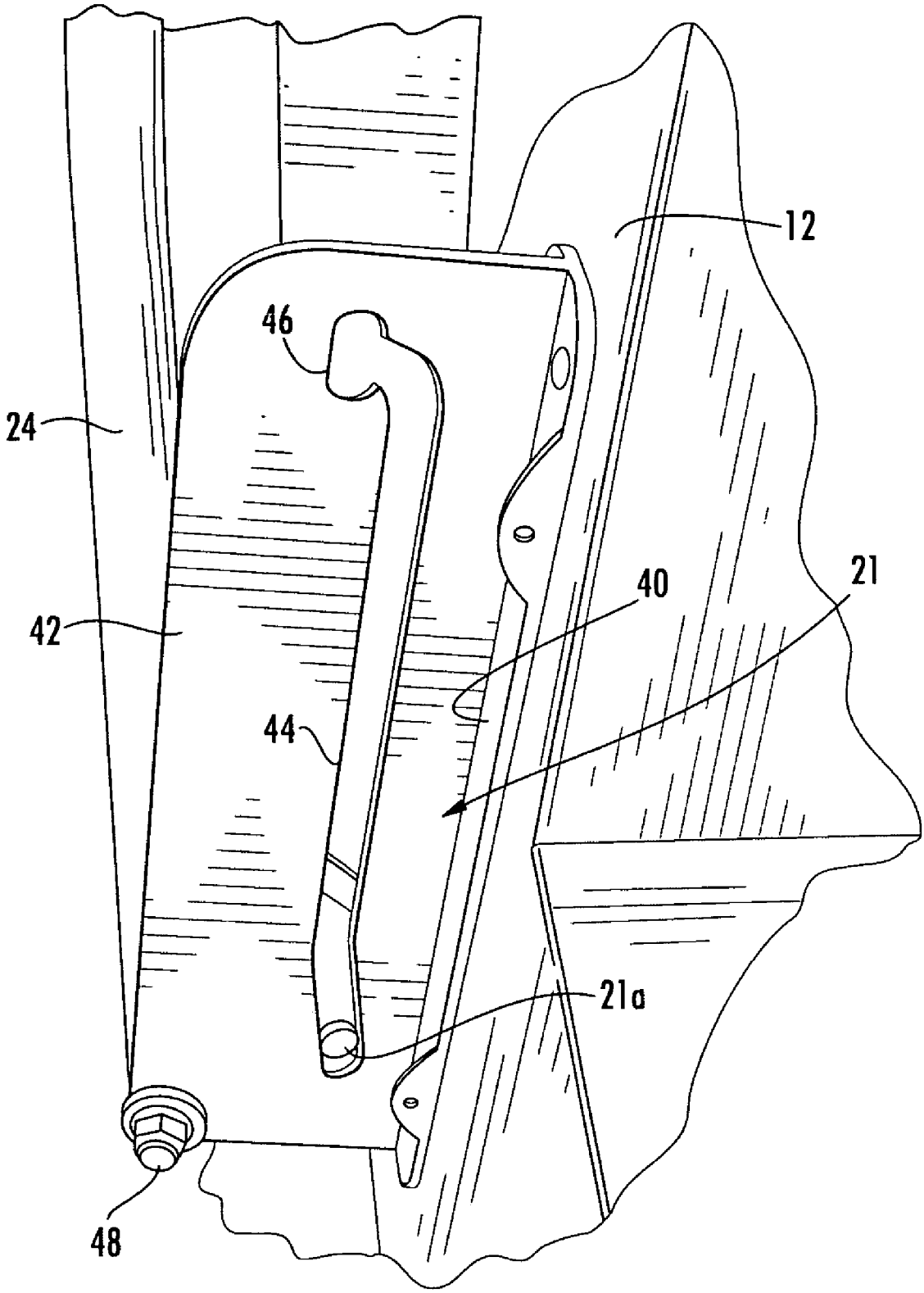
FIG. 4 is a partial side view of the seat of FIG. 1.

With additional reference to FIG. 4, each of the guide plates 21 and 22 are preferably of welded stainless steel construction and each includes a mounting flange 40 and a main plate 42 extending outwardly from the mounting flange 40. The mounting flange 40 is preferably configured to be positioned flat against the bulkhead 12 and may include apertures or the like for passage of fasteners, such as screws or the like, for securing the guide plate 21 to the bulkhead 12.

The main plate 42 defines a guide slot 44 for guidably receiving the guide 21*a*. The guide slot 44 is preferably an elongate and generally linear slot defined through the main plate 42, with a bulbous upper end 46 that is laterally offset from the length axis of the slot 44. As explained in more detail below in connection with FIG. 5, the configuration of the upper end 46 of the slot 44 helps to maintain the support 20 in position when sat upon and to prevent the support 20 from inadvertently returning to a stowed or folded orientation during use. The guide plate 22 is preferably substantially identical to the guide plate 21, except configured for mounting on the opposite side of the support 20. A plastic cover or the like may preferably be positioned to overlie the exterior of the guide plates 21 and 22 for aesthetics and to avoid exposure of moving parts.

The guide followers 21*a* and 22*a* are preferably provided as portions of steel rods which extend from the rearward sides of the support 20, alternatively, the guide followers 21*a* and 22*a* may preferably be provided as by the opposite ends of a rod that extends through a rear portion of the support 20 and the guide followers 21*a* and 22*a* slide in the guide slots 44 of the guide plates 21 and 22.

The leg frame 24 is preferably provided as by a U-shaped portion of stainless steel tubing. The opposite free ends of the leg frame 24 may be pivotally mounted to the guide plates 21 and 22 as by bolts 48 and 50, respectively, passed through corresponding apertures defined through the ends of the leg frame 24 and the guide plates 21 and 22, and secured as by nuts threaded onto the bolts. The central portion of the leg frame 24 is preferably retained against the abutment 35 by metal straps 52 secured to the lower surface 33 of the support 20 as by screws or other fasteners. This orientation advantageously positions the leg frame 24 underneath the support 20 when the support 20 is oriented for use (FIG. 1), and compactly locates the leg frame 24 against the surface 33 when the system is stowed (FIG. 2).

The bias strut 26 is preferably a pneumatic or hydraulic strut, such as a standard gas shock absorber, nitrogen cylinder or the like, having opposing ends 54 and 55. The end 54 is pivotally mounted to the bolt 48 by a ball stud 56. The end 55 is pivotally mounted by a ball stud 57 to a bracket 58 secured to the surface 33, as by screws, within the recess 36.

The bias strut 27 is preferably substantially identical to the bias strut 26 and mounted in a similar manner.

The bias struts 26 and 27 assist in positioning of the support 20 from the folded or stowed orientation of FIG. 2 to the unfolded or use orientation as shown in FIG. 1. For example, the bias struts 26 and 27 are of compressed length when the support 20 is stowed, and are of extended length when the support 20 is in the use position. Thus, to deploy the support for use, a user may grasp the frame 24 by use of the handle recess 34 and exert an upward force to start upward movement of the guides in the guide slots, at which point the bias struts 26 and 27 will elongate and force the guide followers 21*a* and 22*a* upwardly along the slots 44 to the position shown in FIG. 5. The bias struts 26 and 27 urges the support 20 up and away from the bulkhead 12 and thus tends to hold the guide followers 21*a* and 22*a* in the bulbous upper end 46.

The bias struts 26 and 27 also help to inhibit rattling of the support 20, such as when a boat is moving through the water with the support 20 deployed but not being sat in. For example, and with reference to FIG. 5, the guide 21*a* is shown bearing against an upper lobe 46*a* of the bulbous upper end 46 of the slot 44 with the upwardly oriented bias of the bias strut 26 maintaining this relationship of the guide 21*a* relative to the bulbous upper end 46. In this orientation, it has been observed that the components of the system tend not to rattle when the boat is in use.

Figure 5:
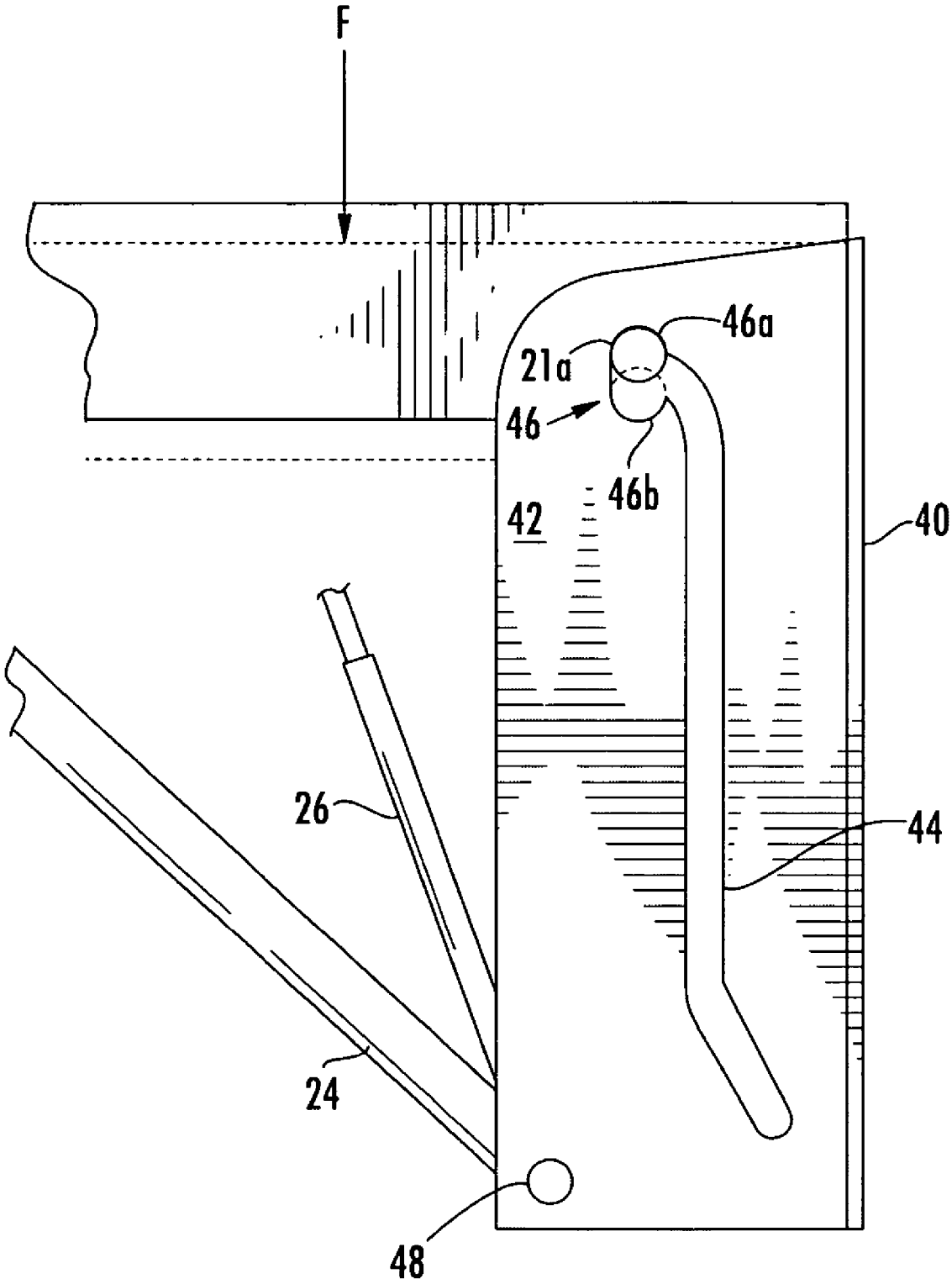
FIG. 5 is a side view showing a securement feature of the seat which engages when the seat is sat upon.

With continuing reference to FIG. 5, the support 20 is shown (in phantom) in a lower orientation when subjected to a force F, such as when a user sits on the support 20. In this circumstance, the force F, e.g., the weight of the user, is sufficient to overcome the upward bias of the bias struts 26 and 27 so that the guide followers 21*a* and 22*a* become oriented in a lower lobe 46*b* of the bulbous upper end 46. It has been observed that this orientation inhibits the ability of the support 20 to be returned to the folded or stowed orientation such that accidental return of the system to a folded or stowed orientation when a user is seated is avoided. However, when the user is no longer seated, the bias struts 26 and 27 again urge the guide followers 21*a* and 22*a* into the upper lobes, such as lobe 46*a*, and the system may be folded or stowed by pressing downwardly on the support 20 sufficiently to position the guide followers 21*a* and 22*a* at the mouth of the upper end 46 and then pushing downwardly to fold the support 20 down and slide the guide followers 21*a* and 22*a* down the slots 44 and 46. If desired, a strap or the like may be utilized to help maintain the system in the stowed orientation.

In the stowed orientation (FIG. 2) the system is advantageously compact and configured so as to not impede toe room of the user relative to the bulkhead 12. For example, during fishing a user may want to stand next to the bulkhead. As will be appreciated, no structure of the system is mounted to the floor and the stowed orientation leaves sufficient clearance so that a user may stand with the toes of the foot of the user against the bulkhead. The cushioned seat surface 30 is also pressed against the bulkhead 12 when the system is in the stowed orientation to help avoid opportunities for damage to the cushioned seat surface 30.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A folding seat mountable to a vertical mounting surface and movable between a use position and a stowed position, the system comprising:

a substantially planar seat having an upper seat surface and an opposite lower surface movable between the use position and the stowed position;

a pair of guide followers extending from opposite sides of the seat;

a pair of guide plates mountable to the mounting surface and each including an elongate guide slot that is oriented generally vertically when the guide plate is mounted to the mounting surface, the guide slot being configured for receiving one of the guide followers and configured to have a generally bulbous upper end that is laterally offset from the slot and includes upper and lower lobes;

a substantially U-shaped frame member for supporting the lower surface of the seat and having opposite ends pivotally mounted at a fixed position below the seat when the seat is in the use position;

a pair of bias struts, each having a first end pivotally mounted at a fixed position below the seat in the use position and a second end pivotally mounted adjacent to the lower surface of the seat, wherein, when the seat is in a stowed position, the seat is substantially parallel to the mounting surface with the lower surface facing away from the mounting surface and the upper seat surface facing the mounting surface, and when the system is in a use position, the seat is substantially perpendicular to the mounting surface;

wherein when the seat is subjected to a force supplied by a user sitting on the seat, the force is sufficient to overcome an upward bias supplied by the bias struts so that the guide followers become oriented in the lower lobes of the bulbous upper ends of the guide slots to inhibit accidental return of the seat to the stowed position while the user is seated; and wherein when the user is no longer seated, the bias struts urge the guide followers into the upper lobes of the bulbous upper ends of the guide slots.

2. The seat of claim 1, wherein the bias struts comprise pneumatic struts.

* * * * *